United States Patent [19]

Mah

[11] Patent Number: 4,481,892

[45] Date of Patent: Nov. 13, 1984

[54] ATMOSPHERIC FLUIDIZED BED COMBUSTOR

[76] Inventor: Clifford S. Mah, 5421 Home Ct., Carmichael, Calif. 95608

[21] Appl. No.: 519,943

[22] Filed: Aug. 3, 1983

[51] Int. Cl.[3] ..... F23D 1/00

[52] U.S. Cl. ..... 110/263; 110/210; 110/212; 110/216; 110/245; 110/344; 110/345; 110/347; 122/4 D

[58] Field of Search ..... 110/245, 212, 263, 270, 110/216, 346, 347, 344, 345, 210, 211; 122/4 D, 20 B

[56] References Cited

U.S. PATENT DOCUMENTS

| | | | |
|---|---|---|---|
| 4,109,590 | 8/1978 | Mansfield | 110/270 X |
| 4,245,573 | 1/1981 | Dixit et al. | 110/344 X |
| 4,259,911 | 4/1981 | Jones | 110/263 X |
| 4,270,469 | 6/1981 | Gall | 110/245 |
| 4,312,280 | 1/1982 | Shearer | 110/263 X |
| 4,419,940 | 12/1983 | Cosar et al. | 122/4 D X |
| 4,419,965 | 12/1983 | Garcia-Mallol et al. | 110/245 X |

*Primary Examiner*—Edward G. Favors
*Attorney, Agent, or Firm*—Townsend and Townsend

[57] ABSTRACT

A fluidized bed combustion system for burning fuel particles, such as coal. The system includes a housing defining a first combustion region. An endless, flexible, perforate belt is shiftably mounted in the housing for supporting coal particles of relatively large size. A blower below the belt creates fluidized air which entrains smaller coal particles in a fluidized bed above the larger coal particles. The combustion gases arising due to combustion of the coal particles passes through a secondary combustion region in which coal fines are burned. The combustion gases continue upwardly through a scrubber in which limestone particles are entrained in the combustion gases to strip sulfides therefrom. The limestone particles are regenerated by a cyclone separator while the combustion gases travel through a passage containing boilers or other heat exchangers, whereby the heat from the combustion gases is transferred to fluids in the boilers.

10 Claims, 2 Drawing Figures

ATMOSPHERIC FLUIDIZED BED COMBUSTOR

Figure 1:
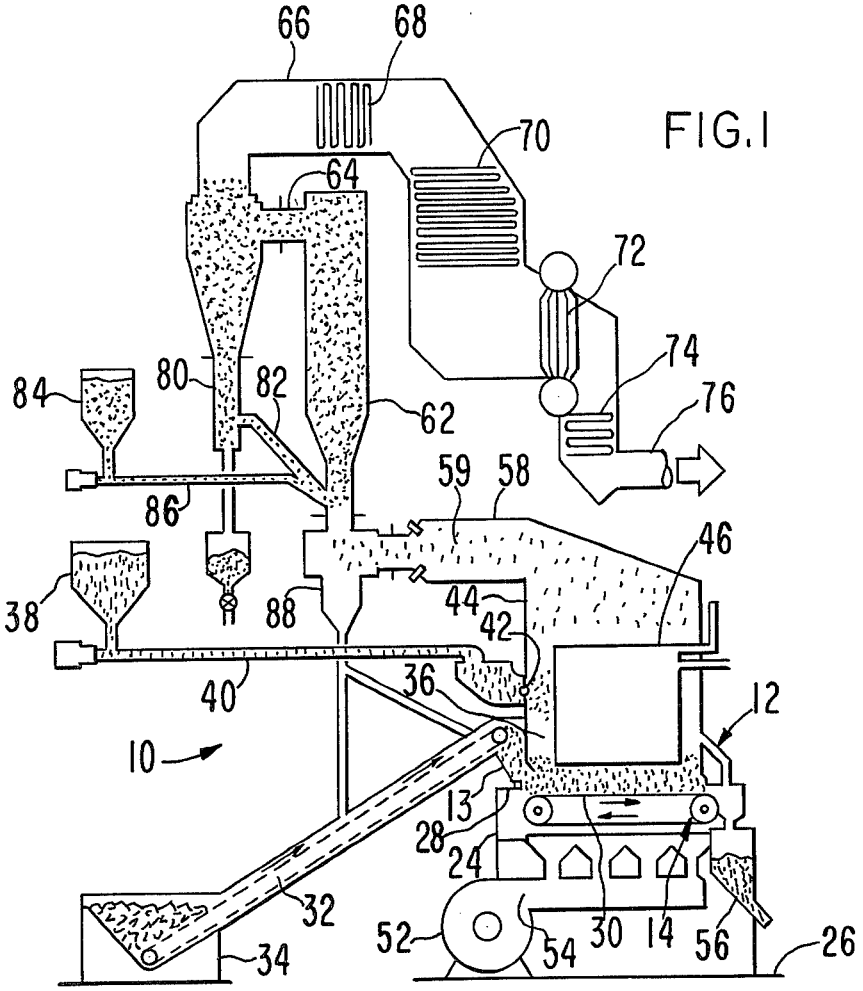

This invention relates to improvements in apparatus and methods for burning coal to obtain heat energy therefrom, and more particularly, to a fluidized bed combustor which uses large and small coal particles for combustion.

BACKGROUND OF THE INVENTION

Fluidized bed combustors have been known and used in the past for the burning of coal and other fossil fuels. However, the combustors have been deficient for one or more reasons. Typically, conventional combustors require that coal particles must be crushed to a particular particle size before the coal can be burned. This requires additional time and equipment and represents an increase in the cost for the recovery the energy in coal.

Conventional fluidized bed combustors have also been inefficient in the removal of coal fines from the combustion gases generated in a primary combustion area of such a fluidized bed combustor. This has typically required reinjection of such fines back into the primary combustor area which, in turn, requires additional equipment and adds to the overall equipment and operational costs.

Sulfur removal from the combustion gases has also been a problem and expensive, elaborate scrubbing equipment has been needed to remove sulfides from the combustion gases, thus further adding to the overall cost of the equipment.

A fluidized bed combustor known by the name Ignifluid boiler has been developed by Albert Godel and marketed by Fives-Cail Babcock. A system of this type uses a moving grate for use as a distributor to burn coal in a fluidized bed, and the system uses substoichiometric air in the fluidized bed. However, the bed operates at a relatively high temperature, such as in the range of 2000° F. to 2500° F., has a relatively low turndown ratio (a measure of heat control from the combustor), a high $NO_x$ generation, and no substantial removal of sulfur from combustion gases. A disclosure of this system is found in an article entitled: "A New Combustion Technique" by Albert Godel, Engineering and Boilerhouse Review, May 1956. Another disclosure of this system is found in an article entitled: "Studies Toward Improved Techniques for Gasifying Coal" by R. A. Graff, City College of New York, Final Technical Report, NSF Grant GI34286A-1, July 31, 1976.

In view of the drawbacks in conventional systems, a need has arisen for an improved fluidized bed combustor which avoids the above-mentioned problems of conventional combustors.

SUMMARY OF THE INVENTION

The present invention satisfies the aforesaid need by providing apparatus and a method for burning coal and other fuel particles of different sizes in a fluidized bed wherein a movable, endless belt provides a static, self-cleaning particle support above which a fluidized bed of fuel particles is maintained. A blower below the support directs fluidizing air through the support and into the fluidized bed as the fuel particles of relatively large size thereon and as relatively smaller fuel particles are entrained in the bed. The fuel particles are all burned in a combustion region in which the bed particles are moving.

The combustion gases rising from the fluidized bed may contain unburned full fines. These unburned fines are burned in a secondary combustion region above the fluidized bed; then, the combustion gases move upwardly by convection through a scrubber containing a sorbent, such as limestone particles, which remove the sulfides from the combustion gases. The sorbent particles are recirculated by regenerating means, such as a cyclone separator, as the combustion gases continue upwardly and into heat exchange relationship with boilers or heat exchanger for creating steam directed to energy producing machines.

The present invention provides a system which will tolerate a variety of fuel types, including coal lignite, culm and agricultural wastes, in a wide range of particle sizes. Staged combustion and temperature control in a fluidized bed results in a minimum $NO_x$ output, approximately 0.1 lb./$10^6$ Btus.

The system of the present invention has superior turndown capability. The control of both moving bed and fluidized bed feedstreams permit a turndown ratio as high as 8:1.

The use of a combustor for burning the coal fines and the fact that this combustor is separated from the scrubbing equipment assures that carbon efficiency will be extremely high. Boiler thermal efficiency can be as high as at least 90%. The scrubber for removing sulfides from the combustion gases provides excellent sorbent contact and temperature conditions for superior sulfur capture performance as will be required as emission standards are made more strict. The scrubber of the present invention preferably uses fine limestone particles, and recirculation of these particles assures adequate time for contact with the combustion gases for effective use of the sorbent.

Preparation of combustion and scrubber processes produces separate ash and sorbent waste streams. Sorbent regeneration is thereby practical. The separate recirculating bed scrubber system opens the possibly for other improvements, such as alkali scavenging, additional removal of oxides of nitrogen, and sonic enhancement (ultra-fine particle capture and micromixing).

The primary object of the present invention is to provide an improved apparatus and method for burning a fuel using a fluidizing bed of fuel particles in a combustion region wherein larger particles are shifted through the combustion region on a moving, perforate, flexible belt while the smaller particles are entrained in a fluidizing bed above the larger particles yet fines travelling upwardly from the fluidizing bed in the combustion gases are burned before they exit to a scrubber where sulfides are removed by contact with a sorbent, all of which can be achieved with minimum equipment, in minimum time, and before the combustion gases are directed to boilers and the like for creating steam for useful work.

Other objects of this invention will become apparent as the following specification progresses, reference being had to the accompanying drawing for an illustration of the invention.

IN THE DRAWINGS

Figure 2:
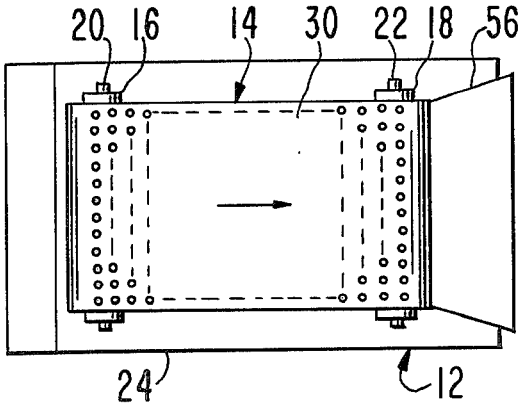

FIG. 1 is a schematic view of a fluidized bed combustor system of the present invention; and FIG. 2 is a schematic view of the self-cleaning, perforate belt forming a part of the combustor system of the present invention.

The fluidized bed combustor system of the present invention is broadly denoted by the numeral 10 and includes a primary combustor section 12 having a combustion region 13. An endless, flexible, perforate support or belt 14 is mounted on rollers 16 and 18 for movement relative to the combustion region 13. Rollers 16 and 18 are mounted for rotation on respective shafts 20 and 22 in a housing 24. The housing is adapted to rest on a support surface 26, and the housing includes an intermediate wall 28 provided with an opening at which the upper, horizontal segment 30 of belt 14 is horizontally aligned.

The belt 14 travels in one direction and supports relatively large fuel particles thereon. For purposes of illustration, the fuel is coal. Large coal particles are supplied by way of a conveyor 32 from a first hopper 34 spaced laterally from housing 24. The coal particles are dumped into a chute 36 and onto the upper segment of belt 14. For example, the particles are carried from left to right by belt 14 when viewing FIG. 1. Small coal particles are fed from a second hopper 38 by air pressure or the like through a pipe 40 and to a nozzle 42 where the small particles are distributed in a zone above the large particles on belt segment 30. Nozzle 42 is coupled to an upper extension 44 of housing 24, and extension 44 includes a heat exchanger 46 which has an inlet 48 and an outlet 50. The heat exchanger is used for temperature regulation of combustion gases and receives a flow of water which is heated by the combustion gases. The use of heat exchanger 46 is optional.

Fluidizing air is supplied by a blower 52 having an outlet 54 which passes air upwardly through the lower part of housing 24, through the lower and upper segments of belt 14, and into combustion region 13 to support combustion and to sustain the fluidized bed of particles. The lower part of housing 24 further includes a collector bin 56 for collecting ash gravitating from the right hand side of belt 14, as shown in FIG. 1.

The upper end of housing extension 44 is coupled by a lateral, tubular member 58 which serves as a secondary combustor having a secondary combustion region 59 for coal fines which are unburned in the combustion gases from combustion region 13. Member 58 is fired by a suitable means, such as by ignitors, and the combustion gases from member 58 travels upwardly to a vertical stack 62, then laterally through a tubular segment 64, and then upwardly through a tubular heat exchanger section 66 containing heat exchangers or boilers 68, 70, 72, and 74. The section 66 has an outlet end 76 which is coupled to particle clean-up equipment (not shown) for stripping the effluent before it passes to the atmosphere.

A cyclone separator 78 is coupled with tubular segment 64. The cyclone separator causes particle material to move downwardly toward and into a tubular cylinder 80 which has a return tube 82 for returning particles to the lower end of tubular member 62.

A hopper 84 contains a sorbent, such as limestone particles. Such particles are driven by a pipe 86 by way of air pressure or the like to the lower end of stack 62. The limestone particles are used for sulfur scrubbing purposes to remove sulfur from the combustion gases as they rise from combustor 58. Any fines which are heavy enough at the lower end of member 62 can gravitate by a pipe 88 back into conveyor 32 therebelow.

In operation, coarse coal particles are fed by conveyor 32 from hopper 34 into housing 24 and onto moving belt segment 30 of belt 14. The finer coal particles can be delivered by nozzle 42 into housing 24 at a location above belt segment 30. The blower is actuated to cause blowing air to rise in the housing to fluidize the particles. Then, a torch (not shown) or other source of heat is directed onto the upper segment of the belt 14 and into the fluidized bed to ignite the coal particles and cause them to burn to thereby actuate the combustor.

Combustion continues as fluidizing air is directed upwardly from blower 52. If heat exchanger 46 is present, the temperature of the combustion gases is controlled, such as in the neighborhood of about 1800° F. In the absence of the heat exchanger 46, the temperature of the combustion gases will be higher than 1800° F.

Substantially all unburned coal fines rising with the combustion gases will be burned in secondary combustor 58. This assures complete carbon burn-up and assists in cleaning the combustion gases to remove contaminants therefrom. The effluent then rises in the scrubbing section, first into stack 62 where it mixes with limestone particles directed into stack 62 from hopper 84 by way of pipe 86.

The scrubbed combustion gases then pass upwardly into tubular segment 66 and into heat exchange relationship with heat exchangers 68, 70, 72 and 74. The combustion gases eventually leave tubular segment 66 by way of outlet 76.

System 10 provides a unique combination of a fluidized and static self-cleaning bed with or without a positive temperature regulating heat exchange unit 46 and an efficient, secondary combustor 58. Combustor 58 ensures that unburned carbon from the primary fluidized bed combustor is burned. The effluent from the secondary combustor is then directed through a scrubber operating at optimum temperature to minimize sorbent utilization and then sends the effluent through a convention section to remove the remaining heat therefrom.

The primary combustor in the fluidized bed uses the continuously moving and self-cleaning belt 14 much like a travelling grate of a stoker system. In normal operation, the larger particles of coal are allowed to rest directly on top of the belt, forming a layer approximately two to three inches thick. The coal and the belt together act as a distributor.

The fluidized bed above the belt has coal and ash as the bed material. An air flow of 9 lbs./hr per pound per hour of coalfeed (0.9 stoichiometric) results in a superficial velocity of about 15 ft./sec. through a bed that is nominally 3 ft. deep. This results in a bed heat release rate of approximately $0.350\times10^6$ btu/hr-ft.$^3$.

In certain cases, a significant portion of the heat generated in a fluidized bed must be removed to maintain the bed at lower than the adiabatic flame temperature. The use of a shallow, fuel-rich bed at a high (1800° F.) temperature minimizes the heat transfer requirements to approximately 50% of the heat generated in the boilers.

Achieving the required turndown in bed heat removal has been a continuing problem in atmospheric fluidized bed combustors. The primary approach has been to use essentially a variable-depth bed by way of ash removal with the distributor. On the steam side, the approach of the present invention to variable heat transfer is to use heat exchanger 46. Such heat exchanger exhibits characteristics similar to a variable thermal conductor. The heat removed from the fluidized bed can be passively regulated, depending upon the steam generation by the heat exchanger.

To assure that the coal particles are completely consumed, high turbulence secondary combustor 58 is used for particle burn-up. The rotary air motion in the combustor causes a centrifuging of the larger particles to lower velocity zones near the outer walls of the combustor, thereby increasing the particle stay time as the particle size is increased. This results in the complete consummation of the particles whether they are large or small. Based upon existing information, the time required to burn the largest elutriated particles should be in the order of one second.

The sulfur scavenging system of the present invention uses fine limestone particles in the same size range as the particles used in dry scrubbers. However, because the reaction temperature is near optimum, the contact times can be kept below a half second. Nominally, a calcium/sulfur molar ratio of 1.5 means approximately 0.27 lbs. of limestone per pound of coal. This translates into a very low void fraction. To ensure adequate sulfur to calcium oxide contact, limestone will be recirculated to the extent that at least a 90% sulfur capture can be achieved.

The feature of using a wide range of coal sizes with the combustor of the present invention solves a difficult design problem. In conventional fluidized bed combustors operating with a 10% per second nominal fluidizing velocity, particles above 5,000 microns normally will not fluidize while particles below 300 microns would tend to be elutriated. By using a self-cleaning distributor provided by belt 14 in the present invention, unfluidized particles no longer present a problem. They will burn as in a conventional stoker. The ashes from the combustion will eventually be dumped by the moving distributor plate into collector 56 (FIG. 1).

The fines elutriation from a conventional fluidized bed combustor represents a significant problem. Even if such fines were burned in a secondary combustor, the sulfides thus liberated could not be captured by limestone in the bed, resulting in a further need for control of the sulfides. The solution to this problem of cleaning up the sulfides from the elutriated fines is to provide a sulfur clean-up system put into the process steam after it can be reasonably assured that all of the elutriated coal (and, therefore, sulfur) has been oxidized. This means separating the sulfides clean-up system from the main fluidized bed. This is the approach used with combustor system 10 as shown in FIG. 1.

Once the sulfur clean-up system has been separated from the main combustion bed, other advantages which accrue from this feature can be exploited. These features include a better use of limestone, a potential for alkali removal, and a potential for the reduction of $NO_x$.

System 10 is distinguished over the Ignifluid system developed by Albert Godel and marketed by Fives-Cail Babcock. Each of these systems uses a moving grate for a distributor to burn coal in a fluidized bed and each system uses substoichiometric air in the fluidized bed. The Ignifluid system, however, has a travelling grate/-distributor which is inclined 10° from the horizontal. The width of the grate is typically about 20% of that of the combustion chamber. Coal is fed onto the grate by way of a chute located at the front of the furnace. Fluidizing air (50–60% stoichiometric) is admitted under the grate/distributor by way of compartments which can be regulated to correspond to the fluidized bed above them. Secondary air is admitted above the fluidized bed to complete the combustion process. The total air used is approximately 120%. Ash carried over the flue gas (approximately one-half the coalfeed) is separated and returned to the combustor.

In nominal operation, the bed is maintained at 2000° to 2550° F. with the temperature increasing from the deep end toward the shallow end. The estimated differential is 300° to 400° F.

The superficial velocity of the gas at the lower terminals of the bed is 50 ft./sec. This is slowed to about 25 ft./sec. to the combustion chamber.

The main distinctions between combustor system 10 of the present invention and the Ignifluid system are as follows:

| | System 10 | Ignifluid |
|---|---|---|
| Type of Fluidization | Bubbling Bed | Semi-Spouting Bed |
| Fluidizing Velocity, ft/sec | 12 | 50 |
| Bed Temperature, °F. | <1800 | 2000–2550 |
| Fluidizing Air, % Stoichiometric | 70 | 50–60 |
| Turndown Ratio | 8:1 | 2:1 |
| $NO_x$ Generation, lb./$10^6$ Btu | 0.15 | 0.7 |
| Flyash Burnup | Secondary Combustor | Reinjection |
| Sulfur Removal | Entrained Bed | None |

What is claimed is:

1. A fluidized bed combustion system comprising: means defining a primary combustion region; a movable, perforate support in said combustion region for supporting fuel particles; first fuel feed means adjacent to said defining means for feeding relatively large fuel particles toward and onto the support; second fuel feed means spaced above the first fuel feed means for feeding relatively small fuel particles toward said support; means below the support for creating a flow of air upwardly through the support and into a zone above the support, whereby some of the fuel particles will be fluidized to present a fluidized bed within the combustion region; means above the primary combustion region for forming a secondary combustion region whereby fuel fines directed upwardly with the combustion gases from the primary combustion region can be burned; means at a location spaced above the secondary combustion region for scrubbing the combustion gases therefrom to remove the sulfur content, said scrubbing means including means for directing sorbent particles into the path of travel of the combustion gases flowing from said secondary combustion region; and means downstream of the scrubbing means for placing the combustion gases in heat exchange relationship to a fluid.

2. A system as set forth in claim 1, wherein is included means in the combustion region for regulating temperature of the combustion gases generated therewithin.

3. A system as set forth in claim 2, wherein said regulating means includes a heat exchanger.

4. A system as set forth in claim 1, wherein the secondary combustion chamber extends laterally from the upper end of the means defining the first combustion chamber.

5. A system as set forth in claim 1, wherein said sorbent particles are limestone particles, said scrubbing means having means for regenerating the limestone particles to permit them to be used continuously for scrubbing purposes.

6. A system as set forth in claim 5, wherein the generating means comprises a cyclone separator.

7. A method of energy recovery from fuel particles comprising: directing relatively large fuel particles from a first location toward and onto a movable, perforate support in a first combustion region; feeding relatively small fuel particles from a second location above the first location toward the support for combustion in said combustion region; directing fluidizing air through, and above the support to fluidize at least some of the particles above the support; burning the particles as the particles on the support are moved laterally and as the particles above the support are fluidized, whereby combustion gases will be generated in the first combustion region; directing the combustion gases away from the first combustion region; burning the fuel fines in the combustion gases at a second combustion region spaced above the first combustion region; feeding sorbent particles into the combustion gases at a location spaced above the second combustion region to scrub and remove sulfur from the combustion gases; and moving the scrubbed combustion gases into heat exchange relationship to a fluid for heating the fluid.

8. A method as set forth in claim 7, wherein is included the step of regulating the temperature of the combustion gases in the first combustion region, whereby the temperature of the combustion gases do not exceed a predetermined value.

9. A method as set forth in claim 7, wherein the sorbent particles include limestone particles.

10. A method as set forth in claim 7, wherein said fuel is selected from the group including coal, lignite culm and agricultural wastes.

* * * * *